United States Patent [19]

Kamp

[11] Patent Number: 4,492,276

[45] Date of Patent: Jan. 8, 1985

[54] DOWN-HOLE DRILLING MOTOR AND METHOD FOR DIRECTIONAL DRILLING OF BOREHOLES

[75] Inventor: Anthony W. Kamp, Rijswijk, Netherlands

[73] Assignee: Shell Oil Company, Houston, Tex.

[21] Appl. No.: 541,821

[22] Filed: Oct. 13, 1983

[30] Foreign Application Priority Data

Nov. 17, 1982 [GB] United Kingdom ..... 8232755

[51] Int. Cl.[3] ..... E21B 7/04

[52] U.S. Cl. ..... 175/61; 175/75; 175/107

[58] Field of Search ..... 175/61, 107, 75; 418/48

[56] References Cited

U.S. PATENT DOCUMENTS 2,336,336 12/1943 Zublin ..... 175/107
3,903,974 9/1975 Cullen ..... 175/61 X

FOREIGN PATENT DOCUMENTS 1252703 10/1960 France ..... 175/107
0825822 5/1981 U.S.S.R. ..... 175/107

*Primary Examiner*—Stephen J. Novosad
*Assistant Examiner*—Michael Starinsky
*Attorney, Agent, or Firm*—Paul I. Douglas

[57] ABSTRACT

A down-hole drilling motor is provided with a bearing unit which supports the output shaft in such an inclined position relative to the motor housing, that the central axis of the output shaft intersects the longitudinal axis of the motor housing at a point of intersection located below the lower end of the housing.

Directional drilling of a borehole is carried out by actuating a drill bit by means of the down-hole drilling motor, and simultaneously therewith rotating the drill string—and consequently also the motor housing—over periods that are preceded and succeeded by selected periods over which the drill string is not rotated.

8 Claims, 3 Drawing Figures

DOWN-HOLE DRILLING MOTOR AND METHOD FOR DIRECTIONAL DRILLING OF BOREHOLES

BACKGROUND OF THE INVENTION

The invention relates to a down-hole drilling motor and a method for directional drilling by means of said motor of boreholes in subsurface formations, in the search for valuable materials such as oil and natural gas.

During drilling of a borehole in underground formations it is frequently required to vary or adjust the direction of drilling. Such adjustment of the drilling direction is commonly carried out by a kick-off procedure during which procedure a smoothly curved borehole section is drilled to bring the borehole at the desired course.

Various tools are known in the art for carrying out kick-off procedures. A suitable kick-off tool is disclosed in U.S. Pat. No. 3,260,318. This known tool consists of a down-hole drilling motor of the Moineau type. Part of the housing is bent such that in the operative position of the motor in a borehole, the axis of rotation of the drill bit is inclined with respect to the local borehole direction. During drilling by means of said motor a curved borehole section will be drilled when the drill string—and consequently also the motor housing—is not rotated. This known motor, however, is not suitable for drilling straight borehole sections and for each kick-off operation the motor has thus to be mounted on the drill string which requires a time consuming roundtrip procedure.

A down-hole drilling motor for alternately drilling straight and curved borehole sections is disclosed in U. S. Pat. No. 3,667,556. In this known motor the bearing assembly that supports the output shaft is connected in a pivotable manner to the motor housing. By varying the angle of deflection between the housing and the output shaft straight and curved borehole sections can be drilled at will. Major disadvantages of this known motor reside in the fragility of the pivots between bearing and housing and in the complexity of the remotely controlled positioning system that is responsible for adjusting the angle of deflection.

SUMMARY OF THE INVENTION

An object of the present invention is to provide an improved directional drilling tool that forms a simple and reliable means for directional drilling of a borehole which means does not include a complex control or adjusting system.

A further object of the present invention is to provide a simple and reliable method of directionally drilling of boreholes which method allows to change the direction of drilling without requiring the drill string to be lifted from the hole and to be run in again each time when the drilling direction is to be changed.

Another object of the present invention is to provide a simple and reliable method of drilling straight and curved borehole sections at will by simply manipulating the drill string by means of the rotary table at the drilling floor.

The down-hole drilling motor according to the present invention comprises a motor housing with a longitudinal axis, the upper end of the housing being provided with upper connector means for connecting the motor to the lower end of a drill string, a rotor rotatable relative to the housing, which rotor is connected to an output shaft provided with lower connector means for drill bit, and a bearing unit that supports the output shaft in an inclined position relative to the housing, such that the central axis of the output shaft intersects the longitudinal axis of the housing at a point of intersection located outside the housing and below the lower end of the housing.

In an attractive embodiment of the present invention the point of intersection between the longitudinal axis and the central axis of the output shaft is located near the face of a drill bit being connected to the output shaft.

Various types of down-hole drilling motor may be employed for the purpose of the invention such as electrical motors and hydraulic motors actuated by the mud flow through the drill string. Suitable hydraulic motors are turbines, vane motors and Moineau motors.

A Moineau motor is very useful for application in the present invention since this type of motor is provided with a flexible connection between the rotor and output shaft to compensate the gyrating movement of the rotor in the housing during operation of the motor.

As the down-hole drilling motor is to be inserted in boreholes the motor housing is usually of elongated tubular shape. The housing may be provided with stabilizer means in the form of radially extending stabilizer blades for controlling the motor in the borehole.

In this specification and in the claims the term "longitudinal axis of the motor housing" refers to the central axis of the surface of revolution that envelopes the outer surface of the motor housing. It will be understood that in case the motor housing is provided with stabilizer means, the longitudinal motor axis will be the central axis of the surface of revolution that envelopes the outer surface of the stabilizer means.

The method for directional drilling of a borehole with the down-hole motor of the present invention comprises the steps of (a) connecting a drill bit to the output shaft of the motor and connecting the motor to the lower end of a drill string, and subsequently lowering the drill string, motor and bit in a borehole, (b) actuating the motor and applying weight on bit, and (c) simultaneously with step (b) rotating the drill string over periods that are preceded and succeeded by selected periods in which the drill string is not rotated.

BRIEF DESCRIPTION OF THE DRAWING

The invention will now be explained in more detail by way of example with reference to the accompanying drawings, wherein

In FIGS. 1, 2 and 3 similar reference characters designate similar parts of the drilling assembly.

DESCRIPTION OF A PREFERRED EMBODIMENT

Figure 1:
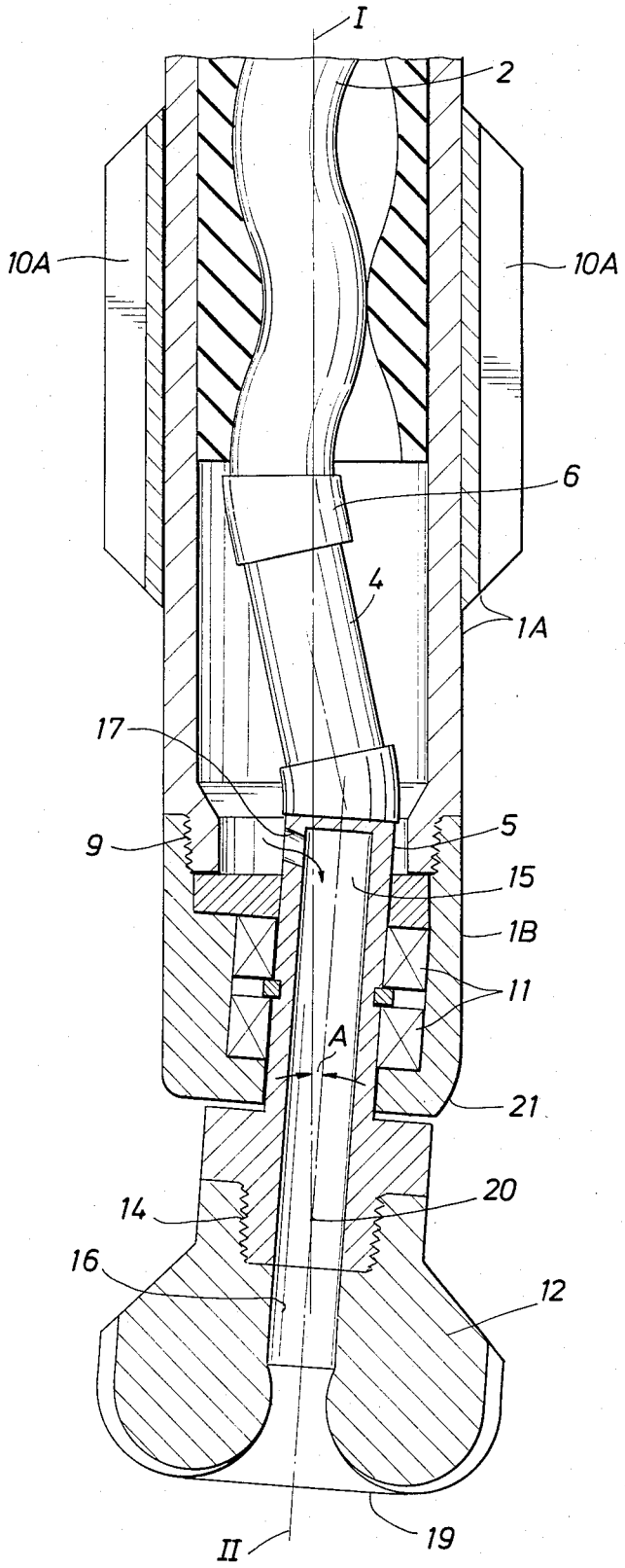
FIG. 1 shows a longitudinal section of the lower part of a down-hole motor according to the invention.

Reference is now made to FIG. 1 showing in detail the lower part of a down-hole motor according to the invention. The motor is a fluid operated motor of the Moineau type consisting of a stator motor housing 1 within which a rotor 2 is rotatably arranged. A connecting rod 4 is connected to the lower end of rotor 2 by means of a universal joint 6 and the lower end of connecting rod 4 is connected to an output shaft 5 by means of another universal joint 7. As the construction and operation of a Moineau motor are known per se, no detailed description of the motor parts and their operation is given in this specification.

The housing 1 includes an upper housing part 1A and a lower housing part 1B, which parts are secured to each other by a screw thread connection 9. The upper housing part 1A is provided with two stabilizers 10A and 10B (see also FIGS. 2 and 3), each stabilizer comprising four radially extending stabilizer blades for centralizing the motor in a borehole. The shape of the stabilizers 10A and 10B is such that a cylindrical surface of revolution (not shown) may envelope the outer surfaces thereof. The central axis of said surface of revolution forms the longitudinal motor axis I. The lower housing part 1B includes a bearing unit 11 comprising suitable thrust and radial bearings for supporting the output shaft 5 such that the shaft 5 is rotatable about its central axis II. A drill bit 12 is detachably mounted on the lower end of the output shaft 3 by connector means consisting of screw thread 14. The shaft 5 and bit 12 comprise inner cavities 15 and 16 communicating with each other for passing drilling liquid to the bit face 19. The upper end of shaft 5 is provided with a port 17 through which drilling liquid that is discharged from the interior of the housing 1 may enter the cavity 15.

In the down-hole drilling motor assembly the bearing unit 11 is arranged in an inclined position in the housing 1, such that the central axis II of the output shaft 5 intersects the longitudinal axis I of the housing 1 at an acute angle A at a point of intersection 20 located outside the housing 1 and below the lower end 21 of the housing 1.

It is observed that in this specification and in the claims the expression "a point of intersection located outside the housing and below the lower end of the housing" indicates that the point of the intersection 20 lies on that part of the longitudinal axis I that protrudes from the lower end 21 of the housing 1.

The purpose of the location of the point of intersection 20 outside the housing 1 and below the lower housing end 21 will be explained together with the method for directional drilling with reference to FIGS. 2 and 3.

Figure 2:
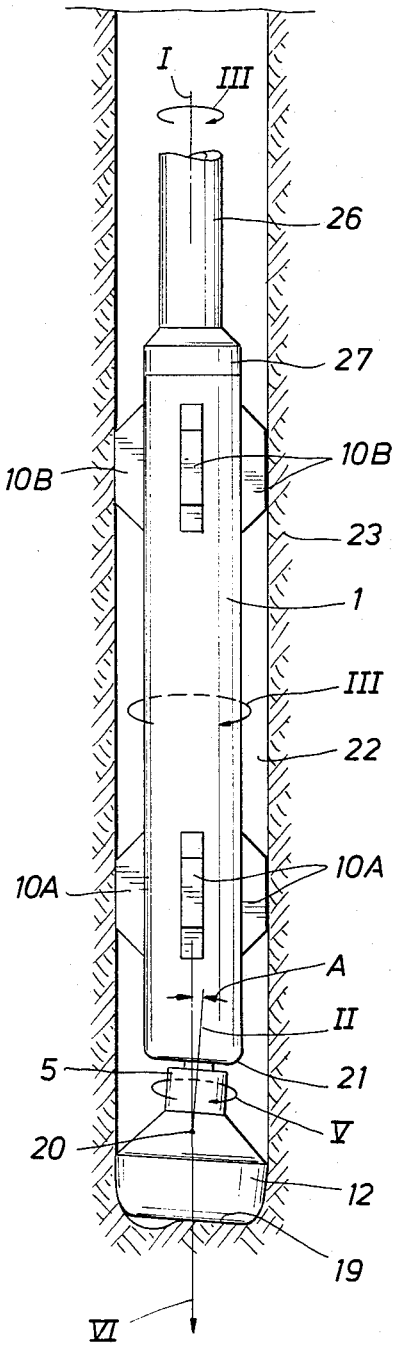
FIG. 2 shows at a smaller scale than FIG. 1 a side view of the motor of FIG. 1 in the operative position thereof during drilling of a straight borehole section.

Reference is first made to FIG. 2 showing a side view of the down-hole drilling motor of FIG. 1 in the operative position thereof during drilling of a straight borehole section 22 (see arrow VI) in a subsurface rock formation 23.

Before starting the drilling operation a drilling assembly has been composed at the surface by connecting the drill bit 12 to the output shaft 5 and by connecting the upper end of the motor housing 1 to the lower end of a drill string 26 by connector means 27 consisting of a screw thread (not shown). The drilling assembly has subsequently been lowered in the borehole 22 until the bit face 19 engages the bottom of the borehole 22 at a predetermined weight on bit.

Liquid is then pumped through the interior of the drill string 26 into the motor housing 1 for actuating the rotor 2 (see FIG. 1) to rotate the output shaft 5 and the bit 12 about the central axis II (see arrow V). The drilling liquid is discharged from the housing 1 via the inner cavities 15 and 16 (See FIG. 1) in the shaft 5 and the bit body 12 to the bit face 19 for cooling and cleaning the cutters thereof and for lifting drill cuttings from the borehole 22.

During drilling the stabilizers 10A and 10B laterally support the motor in the borehole 22 such that the longitudinal axis I of the motor housing 1 substantially coincides with the longitudinal axis of the borehole 22. Drilling of a straight borehole section (see arrow VI) is now performed by rotating the drill string 26 and the motor housing 1 about the longitudinal axis I (see arrow III) and simultaneously therewith rotating the shaft 5 and the bit 12 about the axis II that is inclined to the longitudinal axis I. The drill bit 12 consequently rotates in the borehold 22 about both axes I and II, thereby describing an orbital movement about the longitudinal axis I. Due to this orbital movement the drill bit 12 will deepen the borehole 22 in the direction of the longitudinal axis I, and as a consequence thereof a straight borehole section will be drilled (see arrow VI). As the point 20 of the intersection of the axes I and II (which point 20 forms the centre of the rotation of the bit 12) is located below the lower housing end 21 and thus quite close to the bit face 19 creation of an oversized or spiralling borehole is avoided.

Figure 3:
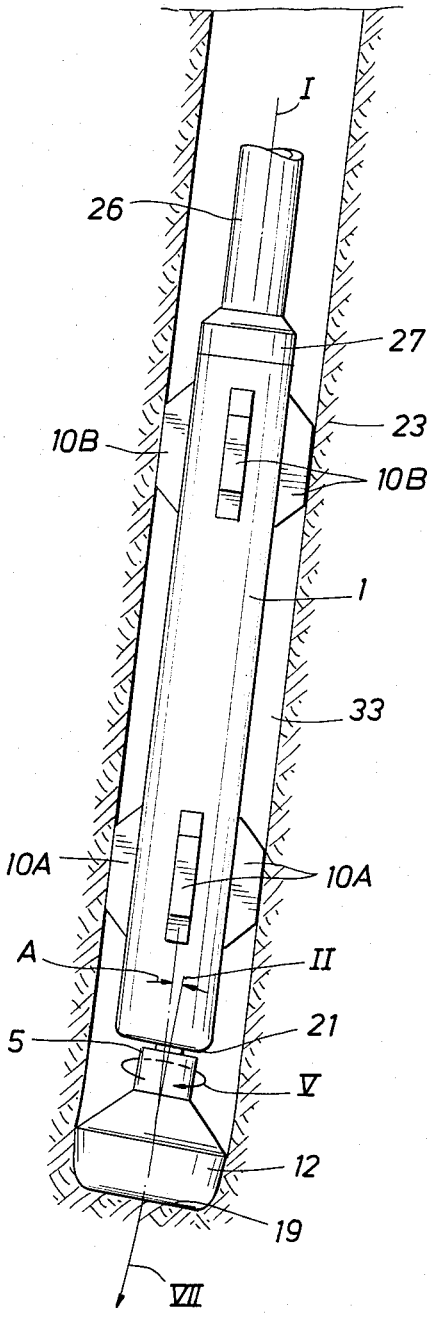
FIG. 3 shows a side view of the motor of FIGS. 1 and 2 but now in the operative position thereof during drilling of a curved borehole section.

Reference is now made to FIG. 3 for explaining the manner wherein a curved borehole section can be drilled.

Contrary to drilling of a straight borehole section, during which the drill string 26 (and consequently the motor housing 1) is rotated, the drill string rotation is stopped during drilling of the curved borehole section 33. The drill bit 12 is now solely driven by the down-hole motor and the bit 12 rotates solely (see arrow V) about the axis II. As the axis II is inclined at an angle A with respect to the longitudinal axis I, the drilling direction deviates from the direction of the lower end of the borehole and a curved borehole section 33 is being drilled. On drilling the curved extension of this section 33 (see arrow VII) the lower stabilizer 10A and subsequently the upper stabilizer 10B enter this extension whereby the tilt of the motor housing 1 is gradually increased, as a result whereof the deviation and the curvature of the borehole extension will further increase.

When the borehole is found to be directed in the desired course, and drilling the hole should be continued in a straight line, the drill string 26 is actuated again (by rotating the rotary table at the drilling rig) to rotate the motor housing 1. A straight borehole section will then be drilled in the way as explained hereinbefore with reference to FIG. 2.

To reach a target area in the subsurface formation 23 the drilling operator will repeat the above described procedure at will. A sequence of straight and curved borehole sections is then drilled by actuating the drill bit 12 by means of the down-hole motor and simultaneously therewith rotating the drill string 26 (by means of the rotary table) over periods that are preceded and succeeded by selected periods over which the drill string 26 is not rotated (and the rotary table is locked).

Each time when a curved section is to be drilled, the drill string rotation is stopped and the motor housing 1 is oriented in the borehole so as to allow the drill bit 12 to deepen the borehole in the desired deviated direction. The orienting procedure may be carried out either by rotating the top end of the drill string 26 over a finite angle by means of the rotary table or by rotating the lower end of the drill string 26 over a finite angle. Rotation of the lower end of the drill string 26 may be performed by varying the drill string twist by adjusting the reaction torque of the motor housing 1 on the lower drill string and either by adjusting the weight-on-bit, or by adjusting the pressure of the drilling liquid that actuates the down-hole motor. When the motor housing 1 has been oriented in the desired direction drilling proceeds whilst the drill string 26 is locked against rotation in the way as explained hereinbefore with reference to FIG. 2.

Optionally the drilling assembly is provided with suitable logging and telemetering equipment to provide the drilling operator with data on the actual borehole direction and motor orientation. Such equipment is known per se and does not require a detailed description thereof.

The invention is not restricted to the use of the Moineau motor shown in the drawing. Any type of down-hole motor known in the art may be used such as a vane motor, a hydraulic turbine or an electric motor. If desired the rotor may be axially aligned with the output shaft (and parallel to the axis II of the output shaft), instead of being parallel to the longitudinal axis I of the housing. In this manner the use of a universal joint between the motor and the output shaft may be avoided.

Furthermore the invention is not restricted to the use of the type of stabilizer means shown in the drawings. Any type of stabilizer means may be used such as concentric stabilizers or eccentric stabilizers. If desired, one or more stabilizers may be mounted on the lower end of the drill string. The use of stabilizers may even be avoided by using a down-hole motor which is provided with a motor housing of a cross-section disclosed in applicant's co-pending application No. 7932750.

It is observed that the angle of inclination A between the longitudinal motor axis I and the axis II of rotation of the output shaft is chosen such that the drill bit (that may be any type of rotary drill bit known in the art) will be able to drill straight and curved borehole sections in the way as explained with reference to FIGS. 2 and 3. Depending on properties of the formation rock and the bit geometry the angle of inclination A may be up to 5%. Most types of drill bits known in the art will be found to be suitable for use in combination with the down-hole drilling motor according to the invention, by selecting the angle of inclination A between 0.25° and 2.5°. By locating the point of the intersection of the axes I and II outside the housing and below the lower end of the housing (and thus quite close to the bit face), these bits will be able to drill straight and curved borehole section at will, without the consequence of creating an oversized or spiralling borehole.

I claim as my invention:

1. Down-hole drilling motor for directional drilling of boreholes in subsurface formations, said motor including a motor housing with a longitudinal axis, said housing being rigid throughout its length at all times, the upper end of the housing being provided with upper connector means for connecting the motor to the lower end of a drill string, a rotor mounted on a rotor shaft and being rotatable relative to the housing, flexible connector means connecting the rotor shaft to an output shaft provided with lower threaded connector means for threaded engagement with a drill bit, and a bearing unit mounted in the lower end of said housing and having an inclined bore therethrough at all times that supports the output shaft in an inclined position relative to the axis of the housing at all times, such that the central axis of rotation of the output shaft intersects the longitudinal axis of the housing at a point of intersection located outside the housing and below the lower end of the housing.

2. The down-hole motor as claimed in claim 1 having a drill bit connected to the lower end of said output shaft, wherein the point of intersection of said axes is located near the face of the drill bit.

3. The down-hole drilling motor as claimed in claim 1, wherein the angle of inclination between the longitudinal housing axis and the central axis of the output shaft is less than 5° at all times.

4. The down-hole drilling motor as claimed in claim 1, outwardly-extending stabilizer means on the motor housing for centralizing the motor in a borehole.

5. The down-hole drilling motor as claimed in claim 3, wherein the output shaft is connected to the rotor by means of a universal joint means.

6. The down-hole drilling motor as claimed in claim 1, wherein the motor is a hydraulically actuated motor.

7. The down-hole drilling motor as claimed in claim 6, wherein the motor is a Moineau motor.

8. Method for directional drilling a borehole with a down-hole drilling apparatus having a housing with a motor therein which drives an output shaft mounted in a bearing in the bottom of said housing in a manner such that the axis of the output shaft is inclined to the axis of the housing comprising the steps of (a) connecting a drill bit inclined to the axis of the housing to the output shaft of the motor and connecting the motor to the lower end of a drill string, and subsequently lowering the drill string, motor and bit in a borehole, (b) continuously actuating the motor and applying weight on bit during the drilling operation, and (c) steering the drilling apparatus within an earth formation simultaneously with step (b) by rotating the drill string over periods of straight hole drilling that are preceded and succeeded by selected periods of curved hole drilling in which the drill string is not rotated while maintaining the axis of rotation of the bit and an angle to the axis of rotation of the housing at all times.

* * * * *

REEXAMINATION CERTIFICATE (1519th)

United States Patent [19]

Kamp

[11] B1 4,492,276

[45] Certificate Issued Jul. 30, 1991

[54] DOWN-HOLE DRILLING MOTOR AND METHOD FOR DIRECTIONAL DRILLING OF BOREHOLES

[75] Inventor: Anthony W. Kamp, Rijswijk, Netherlands

[73] Assignee: Shell Oil Company

Reexamination Request:
No. 90/001,937, Feb. 12, 1990

Reexamination Certificate for:

| | |
|---|---|
| Patent No.: | **4,492,276** |
| Issued: | **Jan. 8, 1985** |
| Appl. No.: | **541,821** |
| Filed: | **Oct. 13, 1983** |

[30] Foreign Application Priority Data

Nov. 17, 1982 [GB] United Kingdom ..... 8232755

[51] Int. Cl.[5] ..... E21B 7/04

[52] U.S. Cl. ..... 175/61; 175/75; 175/107

[56] References Cited

U.S. PATENT DOCUMENTS

| | | | |
|---|---|---|---|
| 1,954,166 | 4/1934 | Campbell | 255/71 |
| 2,336,334 | 12/1943 | Zublin | 255/1.6 |
| 2,336,338 | 12/1943 | Zublin | 255/1.6 |
| 2,344,277 | 3/1944 | Zublin | 255/1.6 |
| 2,382,933 | 8/1945 | Zublin | 255/1.6 |
| 2,664,270 | 12/1953 | Zublin | 255/1.6 |
| 2,712,434 | 7/1955 | Giles et al. | 255/1.6 |
| 3,042,125 | 7/1962 | Duncan | 175/73 |
| 3,045,767 | 7/1962 | Klassen | 175/76 |
| 3,160,218 | 12/1964 | Crake | 175/325 |
| 3,260,318 | 7/1966 | Neilson et al. | 175/75 |
| 3,561,549 | 2/1971 | Garrison et al. | 175/76 |
| 3,563,323 | 2/1971 | Edgecombe | 175/76 |
| 3,586,116 | 6/1971 | Tiraspolsky et al. | 175/74 |
| 3,667,556 | 6/1972 | Henderson | 175/73 |
| 3,713,500 | 1/1973 | Russell | 175/73 |
| 3,743,034 | 7/1973 | Bradley | 175/61 |
| 3,841,420 | 10/1974 | Russell | 175/45 |
| 3,878,903 | 4/1975 | Cherrington | 175/45 |
| 3,903,974 | 9/1975 | Cullen | 175/17 |
| 4,067,404 | 1/1978 | Crase | 175/75 |
| 4,143,722 | 3/1979 | Driver | 175/95 |
| 4,185,704 | 1/1980 | Nixon, Jr. | 175/76 |
| 4,261,425 | 4/1981 | Bodine | 175/106 |
| 4,267,893 | 5/1981 | Mannon, Jr. | 175/65 |
| 4,271,915 | 6/1981 | Bodine | 175/56 |
| 4,319,649 | 3/1982 | Jeter | 175/73 |
| 4,324,297 | 4/1982 | Denison | 175/45 |
| 4,394,881 | 7/1983 | Shirley | 175/76 |
| 4,465,147 | 8/1984 | Feenstra et al. | 175/73 |
| 4,485,879 | 12/1984 | Kamp et al. | 175/61 |
| 4,577,701 | 3/1986 | Dellinger et al. | 175/61 |
| 4,667,751 | 5/1987 | Geczy et al. | 175/61 |
| 4,739,842 | 4/1988 | Kruger et al. | 175/61 |

FOREIGN PATENT DOCUMENTS

| | | |
|---|---|---|
| 1066514 | 10/1959 | Fed. Rep. of Germany . |
| 3417743 | 3/1985 | Fed. Rep. of Germany . |
| 3423465 | 5/1985 | Fed. Rep. of Germany . |
| 1593999 | 7/1970 | France . |
| 2175620 | 10/1973 | France . |
| 2369412 | 5/1978 | France . |
| 294923 | 11/1971 | U.S.S.R. . |
| 625430 | 11/1979 | U.S.S.R. . |
| 1388713 | 3/1975 | United Kingdom . |
| 2059481 | 4/1981 | United Kingdom . |
| 2121453A | 12/1983 | United Kingdom . |
| 2143879A | 2/1985 | United Kingdom . |

OTHER PUBLICATIONS

"Bottom Hole Stress Factors Affecting Drilling Rate at Depth", Wanen/Smith (Amoco), JPT, Aug. 1985.

"Factors Controlling Hole Angle and Direction", B. Wacker (Terra Tek), JPT, Nov. 1986.

"River Crossing Technology", J. Hair, Pipeline and Gas Journal, Jan. 1989.

"Turbine Performance in Texas Offshore Waters", M. E. Bethke (Tenneco), IADC/SPE 14744, Feb. 9–12, 1986, Dallas, Texas.

"Downhole Control of Deviation with Steerable Straight-Hole Turbo-drills", T. M. Gaynor (Neyrfor), IADC/SPE 14769, 2/9–12/86, Dallas.

"Navigation Drilling Technology Progresses", R. Bayne (Eastman Christensen), Drilling, Nov./Dec. 1986.

"Making New Drilling Technology Work for You", S. D. Moore (Petroleum Engineer Internat'l), Petroleum Engineer, Jan. 1987.

"Short-Radius Lateral Drilling: A Completion Alternative", R. W. Fincher (Eastman Christensen), Petroleum Engineer, Feb. 1987.

"High-Angle Drilling Comes of Age", S. D. Moore (Petroleum Engineer) Petroleum Engineer, Feb. 1987.

"Drilling Systems Increase Efficiency", H. Karlsson (Eastman Chrstn) Offshore, Apr. 1987.

"Steerable System Optimizes Drilling Time", D. Easterling (Transco) and W. Jones (Smith Internat'l), Offshore, Apr. 1987.

"Steerable System Saves Time in Straight-Hole Drilling", D. Hall (Gary-Williams) and M. Cooney (Eastman Chrstnsn), Petroleum Eng. 9/87.

"Steerable System Cuts Straight Hole Drilling Costs 50%", D. Nordquist (Sun), and D. Kerr/M. Thomas (Smith Internat'l), Petroleum Eng. 5/88.

"Steerable System Adds Precision to Gulf Drilling", H. Bierschwale (Granstaff), R. Ridley (Smith Int'l), Oil & Gas Journal, 5/2/88.

"Elf Has Set Up Rules for Horizontal Drilling", A. P. Jourdan(Elf), P. Armessen (Anadrill), P. Rousselet (Elf), Oil & Gas Journal, 5/9/88.

"Horizontal Drilling of Eolian Nugget Sandstone in Overthrust Belt" Greener/Sauvageau/Pasternack (Amoco), SPE 17527, Casper WY, 5/88.

"MWD Aids Vital Drilling Decisions", Fontenot (Completion Tech.), Rao (NL Drilling), Oil & Gas Journal, 3/14/88.

New Publications, "Steerable Drilling System", ad in Offshore Mag. Apr. 1988.

"Steerable Motor Systems in the Gulf of Mexico", B. Burton (Burton & Co.), Drilling, May/Jun. 1988.
New Publications, "Steerable Drilling System", ad in Offshore Mag. Aug. 1988.
"First Lateral Well in North Sea Completed", Newsdesk, Petroleum Review, Oct. 1988.
"Amoco Completes Record North Sea Directional Well", Offshore Mag. Nov. 1988.
"Extended Reach Appraisal Well: A Case History", Locke/Johnson (Amoco) Jewkes (Eastmn Chrstnsn), SPE Paper 17564, Tianjin, China, 11/1-4/88.
"Enchova Blowout: Record Relief Time", Maduro (Petrobras) and Reynolds (Smith Intl), SPE/IADC Paper 18717, New Orleans, La., Feb./Mar. 1989.
"Unleashing the Power of Steerable Systems", Whitten/Petrey (Teleco) SPE/IADC Paper 18655, Feb./-Mar. 1989, New Orleans, LA.
"Controlled Horizontal Drilling", P. F. Conti (Baker Hughes), SPE Paper 18708, Feb./Mar. 1989, New Orleans, LA.
"Benefits, Limitations, and Applicability of Steerable System", DeLucia (Smith Intl), SPE/IADC Paper 18656, 2-3/89, New Orleans, LA.
"Case History of Horizontal Wells Drilled With Navigation Technology in European Operations", Ehlers/-Kracht/Witte (Eastmn Chrstsn), SPE Paper 18654, Feb./Mar. 1989, New Orleans, LA.
"Horizontal Drilling is Becoming Commonplace: Here's How Its Done" Giannesini (Horwell), World Oil, Mar. 1989.
"BHA Prediction Software Improves Directional Drilling", Delafon (Total Oil Marine), World Oil, Mar. 1989.
New Publications ad, "Directional Drilling System", Offshore Magzn. Apr. 1989.
"BHA Prediction Software Improves Directional Drilling", Part II, Delafon (Total Oil Marine), World Oil, Apr. 1989.
"Horizontal Drilling Evolving from Art to Science", D. Gust (Esso) Oil & Gas Journal, Jul. 24, 1989.
"How to Design a Medium-Radius Horizontal Well", G. M. Briggs (Horizontal Drilling Project Mgr., (Drilex), Petroleum Engineer, 9/89.
"Steerable Systems Drilling: The Right Angle for Horizontal Drilling" Claytor/Speed (Smith Intl), King (Western Mining), SPE 19466, 9/89.
"Horizontal Systems Growing More Specialized", Offshore Magazine, Oct. 1989.
"Steerable Unit Nets Top-Hole Drilling Cost Reductions", L. Velser (Maersk), and R. Lyon (Eastmn Chrstsn), Offshore, Oct. 1989.
"New Tools, Techniques Reduce High-Angle Drilling Costs", Offshore Magazine, Nov. 1989.
"Application of Performance Drilling to Directional, Horizontal Wells" G. Briggs (Drilex), Offshore Magazine, Feb. 1990.
"Many MWD Choices Available", Petroleum Engineer International, May 1990.
"Drilling a Record Horizontal Well: A Case History", Brannin (Texaco) Velser(Maersk), Williams (Eastmn Chrstnsn), SPE 19985, Houston, 1990.
"Horizontal Drilling Enhances Production of Austin Chalk Well", Stayton/Peach (Drilex), IADC/SPE 19984, Houston, Feb./Mar., 1990.
"Drilling with Steerable Motors in Large Diameter Holes", Pruitt/Ross/Woodruff (Eastman Chrstnsn), SPE 17190, Dallas, Feb./Mar. 1988.
"Optimization of Deepwater Template Drilling", Mitchell/Allamon/Daugherty/Beato/Sprague (Conoco), OTC 6402, Houston, May, 1990.
"What's Happening in Drilling", Editor, World Oil, Jul. 1990.
Technical Data, "Navigation Drilling System: Diamond Drill Bits", Eastman Christensen brochure, NDS-116.
Case History Data, "Navigation Drilling System:Log #90201, Eastman Christensen brochure, NDS-112.
Case History Data, Navigation Drilling System:Log #81204, Eastman Christensen brochure, NDS-113.
Case History Data, "Navigation Drilling System:Log #80729", Eastman Christensen brochure, NDS-103.
Case History Data, "Navigation Drilling System:Log #80730", Eastman Christensen brochure, NDS-104.
Technical Data, "Double-Tilted U-Joint vs. Single Bend Housing", Eastman Christensen brochure, T-24.
"Case History of a World Record, Drilling Shell's Cormorant Alpha 13 Extended Reach Well", McNicoll (Eastman Chrstnsn brochure) Drilling.
"Worldwide Experience Shows Horizontal Well Success", Karlsson/Bitto (Eastman Christensen), Reprt., World Oil, Mar. 1989.
"Directional Services Available for Variety of Drilling Applications" On Target, Fall, 1988, Eastman Christensen newsletter.
"Horizontal Wells in the Java Sea", Barrett (Arco), Lyon (Eastman Christensen), Reprint from Drilling, May/Jun. 1988.
"Systems Approach Speeds Offshore Drilling Operations", Bitto (Eastman Christensen), Reprint from Ocean Industry, Jul. 1987.
"New Developments in Short-Medium- and Long-Radius Lateral Drilling" Karlsson/Cobbley/Jaques (Eastman Christensen), SPE 18706, Nola, 1989.
"The Navigation Drilling System Proves Effective in Drilling Horizontal Wells in the Java Sea", Barrett-(Arco), Lyon (EC), SPE 17238 '88.
"Drilling with Steerable Motors in Large Diameter Holes", Pruitt/Ross/Woodruff (Eastmn Chrstnsn), SPE 17190, Dallas, 1988.
"Performance Drilling Optimization", Karlsson/Krueger (Norten Christensen), Brassfield (Arco), SPE 13474, New Orleans, 1985.
"Navigation Drilling System:Experience, Technology, Performance", Eastman Christensen Brochure DP-108 11/88.
"Nortrak" Navigation Drilling Systems", Eastman Christensen brochure DP 108, copyright 1985 Norten Christensen.
"Horizontal Drilling Potential, Emphasis: Soft Ground" by C. H. Dowding, Mass. Inst. of Tech., Dept. Civil Eng., Jun. 25, 1975.
"Go-Devil-Crossing the Trinity", 1976:4, Shell News, Shell Oil Co., Houston, Texas.
"ADMA Uses New Technology for Turbo Drilling"

by Phillip Juge, 1979 Drilling Technology Conf., IADC, Mar. 1979, Oil & Gas Journal, 5/14/79.
"Directional Drilling on the Arctic North Slope of Alaska" by P. J. Murray and N. R. Booth, SPE of AIME, SPE 8335, 1979.
"Dyna-Drill", Smith International, Inc., brochure, Feb. 1980.
"Crooked Holes-And How to Help Them Go Straight", J. W. Speer and G. H. Holliday, Oil and Gas Journal, Aug., 1955.
"Gulf's Directional Drilling Technique", R. H. Gross, World Oil, pp. 83-86, Nov. 1963.
"New 'Packed Hole' Tool Combats Hole Deviation", Chad Wiley, Drilling, pp. 62-75, Jun. 1965.
"Directional Drilling Takes Giant Step", Doug Jenkins, Drilling Reprinted from Canadian Petroleum, Feb. 1966.
"Directional Drilling-Steering the Errant Bit", Report printed in Drilling, pp. 23-26, Jan. 1969.
"Turbodrill Assemblies for Deviation Control in the North Sea", by Roy Powell, Petroleum Engineer, Sep. 1973.
"Operators Have Much to Learn About Directional Drilling", by Keith Millheim, Oil and Gas Journal, pp. 62-64, Nov. 6, 1978.
"Proper Application of Directional Tools Key to Success", by Keith Millheim, Oil and Gas Journal, pp. 156-158, 161-162, 11/20/78.
"Single-stabilizer Behavior Described", Keith Millheim, Oil & Gas Journal, Dec. 18, 1978.
"Behavior of Multiple-Stabilizer Bottom-Hole Assemblies", by Keith Millheim, Oil and Gas Journal, Jan. 1, 1979.
"Improved Directional Driling Will Expand Use", by MacDonald et al. pp. 108-113, 120, Oil & Gas Journal, Feb. 26, 1979.
"Mud Pulse PWD Systems Report", M. Gerhart et al., pp. 2301-2306, Journal of Petroleum Technology, Dec. 1981.
"Control Casing Wear with Downhole Motors", pp. 167-170, Technology Oil & Gas Journal, Jun. 7, 1982, R. Hughes/B. Bayoud Report.
"Kicking-Off in Large Diameter Holes", L. J. Durand, pp. 2377-2384 Journal of Petroleum Technology, Oct. 1982.
"Straight Hole Turbodrilling", booklet, edition 1982.
"A Technique for Continuously Controlled Directional Drilling", by Kamp et al., IADC Conference, Dallas, TX, Mar. 19-21, 1984.
"Motor Aids Directional Drilling Accuracy", by Feenstra et al., Drilling Contractor, Jun. 1984.
"PDM vs. Turbodrill: A Drilling Comparison", by DeLucia et al., pp. 17-23, SPE 13026, Sep. 16-19, 1984.
Norton Christensen Double Tilted U-Joint Navigation Sub, Norton Canada Inc. services offer, Nov. 14, 1984.
Technical Description of Navigation Systems for Alternative Directional or Straight Hole Drilling, KSEPL and Christensen.
"Esso Drills World's Longest Horizontal Well", David Yager, pp. 18-24, The Roughneck, Jan. 1985.
"Optimizing Results for Bent-Sub Drilling Applications", M. M. Emery pp. 46-48, Drilling, Feb. 1985.
"A New Drainhole Drilling Tool", by Steenbock, English Language Abstract only, Erdoel-Erdgas, pp. 80-84, Mar. 1985.
"Performance Drilling Optimization", SPE/IADC Paper 13474, by H. Karlsson and V. Krueger, 1985 Drlg. Conference, New Orleans 3/85.
"Factors Affecting the Control of Borehole Angle in Straight and Directional Wells, W. B. Bradley, pp. 679-688, J. of Pet. Tech. 6/85.
"Drill Faster, More Accurately with New Navigation System", Karlsson et al., pp. 38-40, World Oil, Aug. 1, 1985.
"Field Results with the 'Dyna-Drill' in Directional Drilling", by E. P. Garrison, Article, Rotary Drilling Conference Transactions.
"The Neyrfor Steerable Straight Hole Turbodrill Sets New Drilling Records", Neyrfor Turbodrilling Services brochure.
"Exploiting Reservoirs with Horizontal Wells: The Maersk Experience Andersen et al., pp. 24-31, 47, Offshore Magazine, Feb. 1991.

*Primary Examiner*—William P. Neuder

[57] ABSTRACT

A down-hole drilling motor is provided with a bearing unit which supports the output shaft in such an inclined position relative to the motor housing, that the central axis of the output shaft intersects the longitudinal axis of the motor housing at a point of intersection located below the lower end of the housing.

Directional drilling of a borehole is carried out by actuating a drill bit by means of the down-hole drilling motor, and simultaneously therewith rotating the drill string—and consequently also the motor housing—over periods that are preceded and succeeded by selected periods over which the drill string is not rotated.

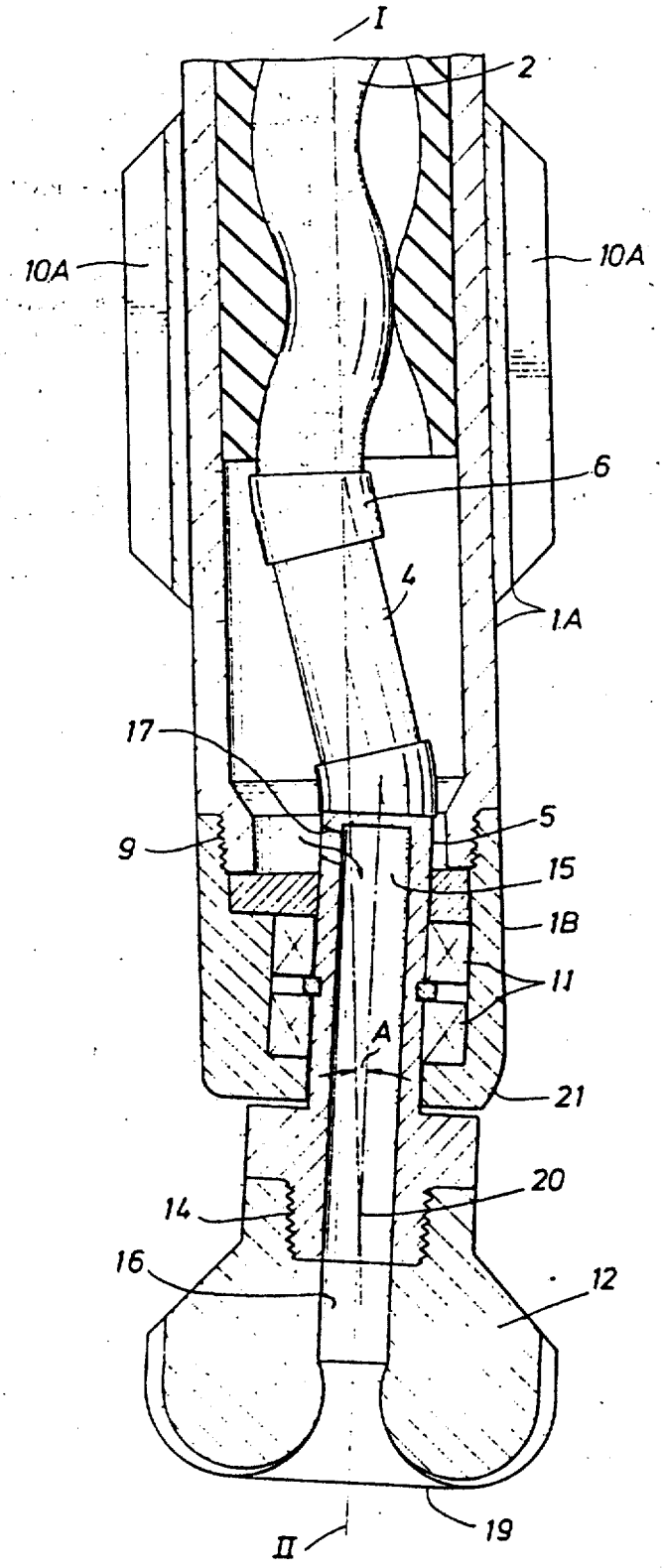
I
2
10A
10A
6
4
1A
17
5
9
15
1B
11
A
21
20
14
16
12
19
II

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-7 is confirmed.

Claim 8 is determined to be patentable as amended.

New claims 9-11 are added and determined to be patentable.

8. Method for directional drilling a borehole with a down-hole drilling apparatus having a housing with a motor therein which drives an output shaft mounted in a bearing in the bottom of said housing in a manner such that the axis of the output shaft is inclined to the axis of the housing comprising the steps of (a) connecting a drill bit inclined to the axis of the housing to the output shaft of the motor and connecting the motor to the lower end of a drill string, and subsequently lowering the drill string, motor and bit in a borehole, (b) continuously actuating the motor and applying weight on bit during the drilling operation, and (c) steering the drilling apparatus within an earth formation simultaneously with step (b) by rotating the drill string over periods of straight hole drilling that are preceded and succeeded by selected periods of curved hole drilling in which the drill string is not rotated while maintaining the axis of rotation of the bit [and] *at* an angle to the axis of rotation of the housing at all times.

*9. A method for directionally drilling a borehole with a downhole drilling apparatus having a housing with a motor therein which drives an output shaft mounted in a bearing in the bottom of said housing in a manner such that the axis of the output shaft is inclined to the axis of the housing, said method comprising the steps of:*

*(a) connecting a drill bit inclined to the axis of the housing to the output shaft of the motor, connecting the motor to the lower end of a drill string, providing at least one stabilizer on the housing, and subsequently lowering the drill string, motor and bit in the borehole;*

*(b) continuously actuating the motor and applying weight on bit during the drilling operation; and*

*(c) steering the drilling apparatus within an earth formation simultaneously with step (b) by rotating the drill string over periods of straight hole drilling that are preceded and succeeded by selected periods of curved hole drilling in which the drill string is not rotated,- while maintaining the axis of rotation of the bit at an angle to the axis of rotation of the housing at all times.*

*10. A method for steerably drilling a borehole for hydrocarbon recovery application, comprising:*

*assembling a bottom hole assembly comprising: connecting a drill bit to an output shaft of a motor which is mounted in a bearing in the bottom of a motor housing, the connection being made in a manner such that the axis of the output shaft is inclined to the axis of the motor housing; providing at least one stabilizer on the motor housing; and connecting the motor to the lower end of a drill string;*

*lowering the bottom hole assembly in the borehole; running the motor; applying weight on bit; and*

*selectively steering the drilling bit to both convert from periods of straight hole drilling to curved hole drilling and from periods of curved hole drilling to straight hole drilling without tripping the bottom hole assembly, said selectively steering the drilling bit comprising:*

*rotating the drill string while driving the drill bit with the motor for straight hole drilling; driving the drill bit with the motor without rotating the drill string for curved hole drilling; and maintaining the axis of rotation of the bit at an angle to the longitudinal axis of rotation of the motor housing at all times.*

*11. A method for steerably drilling a borehole in accordance with claim 10 wherein providing at least one stabilizer comprises providing a plurality of concentric stabilizers on the motor housing.*

* * * * *